United States Patent [19]

Bayley

[11] 4,282,304

[45] Aug. 4, 1981

[54] METHOD OF FORMING MAGNETIC TONER PARTICLES HAVING A CONCENTRATION OF MAGNETIC PARTICLES GREATER THAN 45 PERCENT BY WEIGHT BY DISPERSION POLYMERIZATION TECHNIQUES

[75] Inventor: Robert D. Bayley, Ontario, N.Y.

[73] Assignee: Xerox Corporation, Stamford, Conn.

[21] Appl. No.: 117,935

[22] Filed: Oct. 22, 1979

[51] Int. Cl.[3] ..... G03G 9/08

[52] U.S. Cl. ..... 430/137; 430/107; 260/42.53; 526/88

[58] Field of Search ..... 430/137, 107; 260/42.53; 526/88

[56] References Cited

U.S. PATENT DOCUMENTS

| | | | |
|---|---|---|---|
| 3,959,153 | 5/1976 | Sadamatsu et al. | 430/137 |
| 4,071,670 | 1/1978 | Vanzo | 526/88 |
| 4,097,620 | 6/1978 | Lu | 430/137 |
| 4,148,741 | 4/1979 | Bayley | 430/137 |

*Primary Examiner*—John D. Welsh

*Attorney, Agent, or Firm*—E. O. Palazzo

[57] ABSTRACT

Toner particles are prepared by a dispersion polymerization technique wherein monomer present in the discontinuous phase is removed after sizing of the monomer droplets to thereby increase the weight ratio of magnetic particles present in the completed toner particles.

9 Claims, No Drawings

METHOD OF FORMING MAGNETIC TONER PARTICLES HAVING A CONCENTRATION OF MAGNETIC PARTICLES GREATER THAN 45 PERCENT BY WEIGHT BY DISPERSION POLYMERIZATION TECHNIQUES

BACKGROUND OF THE INVENTION

This invention relates to a method of preparing magnetic toner particles by dispersion polymerization methods and more paticularly to a method of preparing toner particles having a concentration of magnetic material greater than 45 percent by weight by dispersion polymerization methods.

Magnetic toner particles have recently found application in the development of electrostatographic images as single component developers. Single component magnetic developers are particularly applicable in small copiers where size constraints are an important aspect. In some applications, the toner particles are field dependent, that is they are capable of acting as conductors under high electrical fields and capable of acting as insulators under lower electric fields. This permits the development of the latent electrostatic image by induction and the transfer to plain paper by electrostatic techniques.

It has been learned through experimentation that the toner particles should have a concentration of magnetic particles of from about 50 to about 60 percent by weight. Toner particles with such high magnetic particle concentration can be obtained by bulk methods and by spray drying methods. In the bulk method of preparation the magnetic particles and the polymer are blended together by any suitable technique including, for example, mastication on a rubber mill, in Banbury mixers, and the like with subsequent particle size reduction of the bulk material to a suitable size for use as toner. One disadvantage of this technique is that the particle size of the toner is not uniform, thus, classification methods are required in order to achieve a toner composition of uniform particle size.

Spray drying techniques are conducted by dissolving a suitable polymer in a solvent to which is added the proper quantity of magnetic pigment. Subsequently, toner particles are formed by spray drying the solution to achieve toner size spherical particles. This technique is capable of achieving magnetic toner particles having the suitable concentration of magnetic material contained therein however it is generally a rather expensive process and has not found commercial acceptance because of this reason.

A third method of preparing toner particles has been termed the dispersion polymerization method. In this technique, the magnetic particles are first mixed with monomer together with a reaction initiator and subsequently this mixture is suspended in an aqueous medium in which the reaction takes place within each particle resulting in the formation of toner size particles which are then removed from the aqueous medium by conventional techniques. A problem that exists with this technique is that the maximum concentration of magnetic particles in the completed toner particles is from about 40 to about 45 percent by weight. This is not the optimum percentage for use in single component magnetic developing methods.

It is desirable, however, to utilize dispersion polymerization method for the preparation of single component magnetic developer because of its low cost, narrow resulting toner particle size distribution and the reduced number of processing steps employed.

It would, therefore, be desirable to provide single component magnetic developer particles containing greater than 45 percent magnetic particles by weight by a dispersion polymerization method in order that the inherent advantages of the dispersion polymerization method can be obtained.

SUMMARY OF THE INVENTION

Magnetic toner particles having a magnetic pigment concentration of at least 45 percent by weight are achieved by utilizing dispersion polymerization techniques wherein subsequent to the sizing of the monomer droplets in the discontinuous phase, monomer is removed from the reaction mass thereby resulting in an increase of the magnetic pigment in the completed toner particle. The monomer may be removed either before or during the polymerization step.

As pointed out above, in the dispersion polymerization method, the magnetic pigment particles are dispersed together with a polymerization initiator in a vinyl monomer to form what will hereinafter be referred to as the discontinuous phase. This discontinuous phase is then added to an aqueous solution containing a stabilizing agent. The entire mass is rapidly agitated in a shearing type device in order to form particles of the discontinuous phase in the continuous or aqueous phase. The particles of the discontinuous phase are formed such that they are the same as the particle size of the toner particles desired and generally have a diameter of from about 5 to 35 microns. Polymerization is then carried out.

In the preparation of the monomer or discontinuous phase, any suitable vinyl monomer may be employed such as, for example, esters of saturated alcohols with mono and polybasic unsaturated acids, such as, alkyl acrylates and methacrylates, haloacrylates, diethyl maleate, and mixtures thereof; vinyl and vinylidene halides such as vinyl chloride; vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, alphamethyl styrene parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile, phenylacrylonitrile, vinylidene cyanide, and mixtures thereof; N-substituted unsaturated amides such as N,N dimethyl acrylamide, N-methyl acrylamide, and mixtures thereof; conjugated butadienes such as butadiene, isoprene and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinyl coumarone, N-vinyl carbazole, and mixtures thereof; unsaturated alicyclic compounds such as vinyl-cyclopentane, vinyl-cyclohexane and mixtures thereof; unsaturated thio compounds such as vinyl thio-ethers; unsaturated hydrocarbons such as ethylene, propylene, coumarone, indene, terpene, polymerizable hydrocarbon fractions, isobutylene and mixtures thereof; alkyl compounds such as alkyl alcohol, allyl esters, diallyl phthalate, triallylcyanurate and mixtures thereof. Any suitable mixture of copolymerizable monomers of the type described above can also be used in the process of this invention.

In the preparation of the discontinuous or monomer phase, any suitable polymerization initiator can be used such as, for examples, azobisisobutyronitrile (AIBN), benzoyl peroxide, methylethyl ketone peroxide, isopropyl peroxycarbonate, cumene hydroperoxide, 2,4-dichloryl benzoyl peroxide, lauroyl peroxide and the like. Generally, from about 0.5 to about 5 weight percent initiator based on the weight of the monomer is suitable.

Any suitable particulate material exhibiting paramagnetism, that is, capable of being attracted by a magnet, such as, for example, iron and alloys thereof, iron oxide, nickel and alloys thereof, ferrites, magnetite and the like may be used. Magnetite is the preferred material not only because of its paramagnetic properties but because of its color properties. It may be desirable to include other colorants such as dyes and pigments together with the magnetic particles in order to obtain the desired color of the finished toner particles. In order to achieve toner particles having the desired dimensions set forth above, the particle size of the magnetic particles should be from about 0.01 to about 0.5 micron and preferably from about 0.01 to about 0.2 micron.

As indicated above, the discontinuous phase is mixed into the aqueous or continuous phase under high shear and rapid agitation in order to form monomer particles having the particle size of the desired final toner particle as the discontinuous phase. The continuous phase is made up of order and a suitable stabilizing agent, such as for example, polyvinyl alcohol, gelatin, methyl cellulose, methylhydroxy propylcellulose, ethyl cellulose, sodium salt of carboxy methyl cellulose, polyacrylate acids and their salts, starch, gums, alginates, zein, casein, tricalcium phosphate, talc, barium sulfate, bentonite and the like. The stabilizing agent is present in the continuous phase in a stabilizing amount, preferably from about 0.1 to about 1 percent by weight and most preferably in an amount from about 0.1 to about 0.4 percent by weight.

Generally, sufficient monomer phase is added to the aqueous phase to effect a volumetric ratio of monomer phase to aqueous phase ranging from about 0.05:1 to about 1:1, and preferably from about 0.1:1 to about 0.5:1. Any suitable mixing device which will bring about toner size particles in the monomer phase may be employed. Subsequent to the sizing operation of the monomer in the aqueous phase, polymerization is conducted by standard dispersion polymerization techniques, for example, maintaining the temperature over a period of time necessary to bring about complete polymerization. The polymerization is conducted in a suitable apparatus which will permit the removal of a portion of the monomer from the reaction mass, such as, a reaction kettle equipped with a stirrer and an inlet and outlet for the purge of an inert gas for carrying out unreacted monomer vapor. The device is connected to a condenser or cold trap for collecting the monomer vapor thus removing a portion thereof from the reactive mass. Thus, in order to increase the ratio of the magnetic particles in the completed toner in amounts sufficient to result in a particle containing from about 45 to about 60 weight percent of magnetic particles, from about 10 to 25 percent by weight of the monomer initially present should be removed from the reaction mass. This high percentage of magnetic particles in the completed toner particles will not result by initially reducing the quantity of monomer present in the starting mix.

The invention will be further illustrated by the following examples in which parts are by weight unless otherwise specified:

EXAMPLE I

About 300 parts of styrene, about 21 parts of lauroyl peroxide and about 244 parts of particulate magnetite having a particle size of about 0.1 micron is added to a Waring Blender and mixed at high shear for about 10 minutes to insure wetting and dispersing of the magnetite and the liquid components. About 100 parts of this slurry is added to about 500 parts by volume of a 1 percent by volume polyvinyl alcohol solution in water. The polyvinyl alcohol is 88% hydrolyzid and has a weight average molecular weight of about 60,000. This suspension is subjected to high shear in a Waring Blender equipped with a Polytron head to achieve a suspension of approximately 12 micron droplets of the discontinuous monomer phase in the continuous aqueous phase. About 436 parts of this size suspension reaction mass is added to a reaction vessel equipped with a paddle blade stirrer and an inert gas inlet and outlet, the outlet being connected to a cold trap. The temperature of the reaction vessel is raised gradually to about 70° C. while nitrogen is purged through the vessel. 100 percent conversion of the monomer to polymer is observed after about 7.5 hours at which time the cold trap has collected about 8 parts of monomer. This represents a 21 percent loss of total monomer which corresponds to a 5 percent increase in the magnetite concentration of the completed particles. The completed toner particles are separated from the reaction mass by filtration. The magnetite content of the toner particles is about 50 percent as measured by thermal gravimetric analysis.

EXAMPLE II

About 100 parts of slurry made up of about 37.5 parts styrene, about 17.5 parts n-butyl methacrylate, about 2 parts benzoyl peroxide and about 45 parts particulate magnetite is sized into about 500 parts by volume of a 0.5% polyvinyl alcohol solution in water. The temperature is raised to about 75° and maintained for about 2.5 hours before raising to about 90° to complete polymerization in 5.0 hours. A nitrogen purge as in Example I during the run removes about 24 parts of monomer. Thermal gravimetric analysis indicates that the resulting toner exhibits about 59.5% magnetite, an increase of 9.5%.

EXAMPLE III

About 300 parts of a slurry made up of about 53 parts methyl methacrylate, about 2 parts azo bis-2-methyl propionitrile and about 45 parts iron oxide is sized into about 500 parts by volume of a 0.75% polyvinyl alcohol solution in water. The reacting vessel is maintained at about 60° C. for about 3.5 hours before completing polymerization at about 78° C. for about 3 hours. A nitrogen purge as in Example I removes about 49.4 parts of monomer which corresponds to an increase of iron oxide of 9.0% by weight. Thermal gravimetric analysis shows 54.3% by weight of iron oxide in resulting toner.

EXAMPLE IV

About 200 parts of a slurry made up of about 35 parts styrene, about 15 parts isobutyl methacrylate, about 0.5 part lauroyl peroxide and about 45 parts magnetite is sized into about 500 parts by volume of a 0.2% polyvinyl alcohol solution in water. A nitrogen purge as in Example I eliminates about 23 parts monomer during a 3 hour period at about 55° C. The temperature of the reaction is then raised to about 70° C. for about 4.5 hours to complete polymerization. Thermal gravimetric analysis shows a magnetite concentration of 50.5% by weight.

Other modifications of the present invention will be apparent to those skilled in the art, such as the polymerization of any of the monomers, initiators, stabilizing agents or magnetic particles set forth.

What is claimed is:

1. A method of making magnetic toner particles by a dispersion polymerization technique comprising dispersing magnetic particles and a polymerization initiator in a vinyl monomer, sizing the monomer by forming a suspension of toner size droplets in an aqueous medium containing a stabilizing agent, removing monomer from the sized droplets subsequent to formation of the suspension whereby the concentration of magnetic particles in the polymerized particles is increased to greater than 45 percent by weight and separating the polymerized particles from the reaction mixture.

2. The method of claim 1 wherein the monomer is removed from the sized droplets, prior to the polymerizing step.

3. The method of claim 1 wherein the monomer is removed from the sized droplets during the polymerizing step.

4. The method of claim 1 wherein the monomer is removed from the sized droplets bath before and during the polymerization step.

5. The method of claim 1 wherein the original concentration of magnetic particles in the monomer is from about 40 to about 45 percent by weight.

6. The method of claim 1 wherein the droplet size of the monomer containing magnetic particles is from about 5 to about 30 microns.

7. The method of claim 1 wherein the magnetic particles are magnetite.

8. The method of claim 1 wherein the volumetric ratio of the continuous phase to aqueous phase is from about 0.05 to about 1:1.

9. The method of claim 5 wherein the volumetric ratio is from about 0.1:1 to about 0.5:1.

* * * * *